US007913558B2

(12) United States Patent
Sarshar et al.

(10) Patent No.: US 7,913,558 B2
(45) **Date of Patent: *Mar. 29, 2011**

(54) METHOD FOR PREVENTION/DETECTION OF MECHANICAL OVERLOAD IN A RECIPROCATING GAS COMPRESSOR

(75) Inventors: Hamid Reza Sarshar, The Woodlands, TX (US); Vinh K. Do, Houston, TX (US); Simone Pratesi, Vicchio (IT); Nicola Campo, Florence (IT); Jeffrey Raynal, Houston, TX (US)

(73) Assignee: Nuovo Pignone Holdings, S.p.A., Florence (IT)

( * ) Notice: Subject to any disclaimer, the term of this patent is extended or adjusted under 35 U.S.C. 154(b) by 905 days.

This patent is subject to a terminal disclaimer.

(21) Appl. No.: 11/680,009

(22) Filed: Feb. 28, 2007

(65) Prior Publication Data

US 2008/0206069 A1 Aug. 28, 2008

(51) Int. Cl.
*G01M 19/00* (2006.01)

(52) U.S. Cl. ..... 73/168

(58) Field of Classification Search ..... 73/168
See application file for complete search history.

(56) References Cited

U.S. PATENT DOCUMENTS

| | | | | |
|---|---|---|---|---|
| 4,095,515 | A * | 6/1978 | MacKay | 99/337 |
| 6,540,481 | B2 | 4/2003 | Moussa et al. | |
| 6,794,766 | B2 | 9/2004 | Wickert et al. | |
| 6,969,239 | B2 | 11/2005 | Grant et al. | |
| 7,101,151 | B2 | 9/2006 | Loringer et al. | |
| 2005/0224025 | A1 * | 10/2005 | Sanderson | 123/48 B |

* cited by examiner

*Primary Examiner* — Andre J Allen
(74) *Attorney, Agent, or Firm* — Potomac Patent Group PLLC

(57) ABSTRACT

Mechanical overloads in a reciprocating gas compressor can cause irreparable damage to compressor components if the source of the overloads is not repaired. A method of detecting mechanical overloads includes applying an overload indicator across an interface between components in the compressor, and observing a mechanical condition of the overload indicator. The mechanical condition of the overload indicator is indicative of whether the compressor experienced a mechanical overload. By placing the indicator in an appropriate location in the compressor, overload conditions can be checked during routine inspections and maintenance checks.

18 Claims, 2 Drawing Sheets

METHOD FOR PREVENTION/DETECTION OF MECHANICAL OVERLOAD IN A RECIPROCATING GAS COMPRESSOR

BACKGROUND OF THE INVENTION

The invention relates to gas compressor maintenance and reliability and, more particularly, to a method for prevention/detection of mechanical overload in a reciprocating gas compressor.

An overload condition in a gas compressor can cause damage to compressor components that may affect operation and efficiency of the compressor. Repeated overload occurrences can compound damage to the compressor components, often beyond repair.

Currently, there is no ability beyond observing normal operation of the compressor to determine whether the compressor experienced an overload event. For example, excessive vibration during operation of the compressor provides evidence of a problem, which may have been caused by an overload condition after which the compressor can be shut down and inspected. At this point, however, equipment damage may be beyond repair.

It would thus be desirable to enable detection of an overload condition during routine maintenance and inspection of the compressor so that the problem or defect in the compressor components can be corrected before further damage is caused due to persistent overload events.

BRIEF DESCRIPTION OF THE INVENTION

In an exemplary embodiment of the invention, a method of detecting mechanical overload in a reciprocating gas compressor includes the steps of applying an overload indicator across an interface between components in the compressor, and observing a mechanical condition of the overload indicator. The mechanical condition of the overload indicator is indicative of whether the compressor experienced a mechanical overload.

In another exemplary embodiment of the invention, a method of detecting mechanical overload in a reciprocating gas compressor includes the steps of forming at least one aperture at least one joint interface adjacent one of a cylinder crank end and a cylinder head end of the compressor; securing a corresponding at least one indicator member in the at least one aperture; and observing a mechanical condition of the indicator member, wherein the mechanical condition of the indicator member is indicative of whether the compressor experienced a mechanical overload.

In yet another exemplary embodiment of the invention, a method of preventing damage to components of a reciprocating gas compressor due to mechanical overload includes the steps of applying an overload indicator across an interface between components in the compressor, observing a mechanical condition of the overload indicator, where the mechanical condition of the overload indicator is indicative of whether the compressor experienced a mechanical overload; and if a mechanical overload is detected, repairing the mechanical overload source before the compressor components are irreparably damaged.

DETAILED DESCRIPTION OF THE INVENTION

Gas compressors and systems are used to pressurize and circulate gas through a process, enhance conditions for chemical reactions, provide inert gas for safety or control systems, recover and recompress process gas, and maintain correct pressure levels by either adding and removing gas or vapors from a process system. Gas compressors work in multiple stages (up to four). In the first stage, gas flows through an inlet check valve and fills a larger diameter first-stage cylinder. A piston assembly is driven in one direction, compressing the gas in the first-stage cylinder. Gas in the first-stage cylinder flows through suitable valves into a smaller diameter second-stage cylinder.

At the end of the first stage, the piston assembly is driven in the other direction compressing gas in a second-stage cylinder. Further compression stages operate to further compress the gas, and after the last compression stage, gas flows out of the last-stage cylinder into a discharge gas line. The piston assembly reverses direction at the end of the stroke, and the cycle repeats.

There are four broad categories of compressor types. There are many variations within each type: reciprocating compressor, fan/blower compressors, rotary compressors, and ejector compressors.

Figure 1:
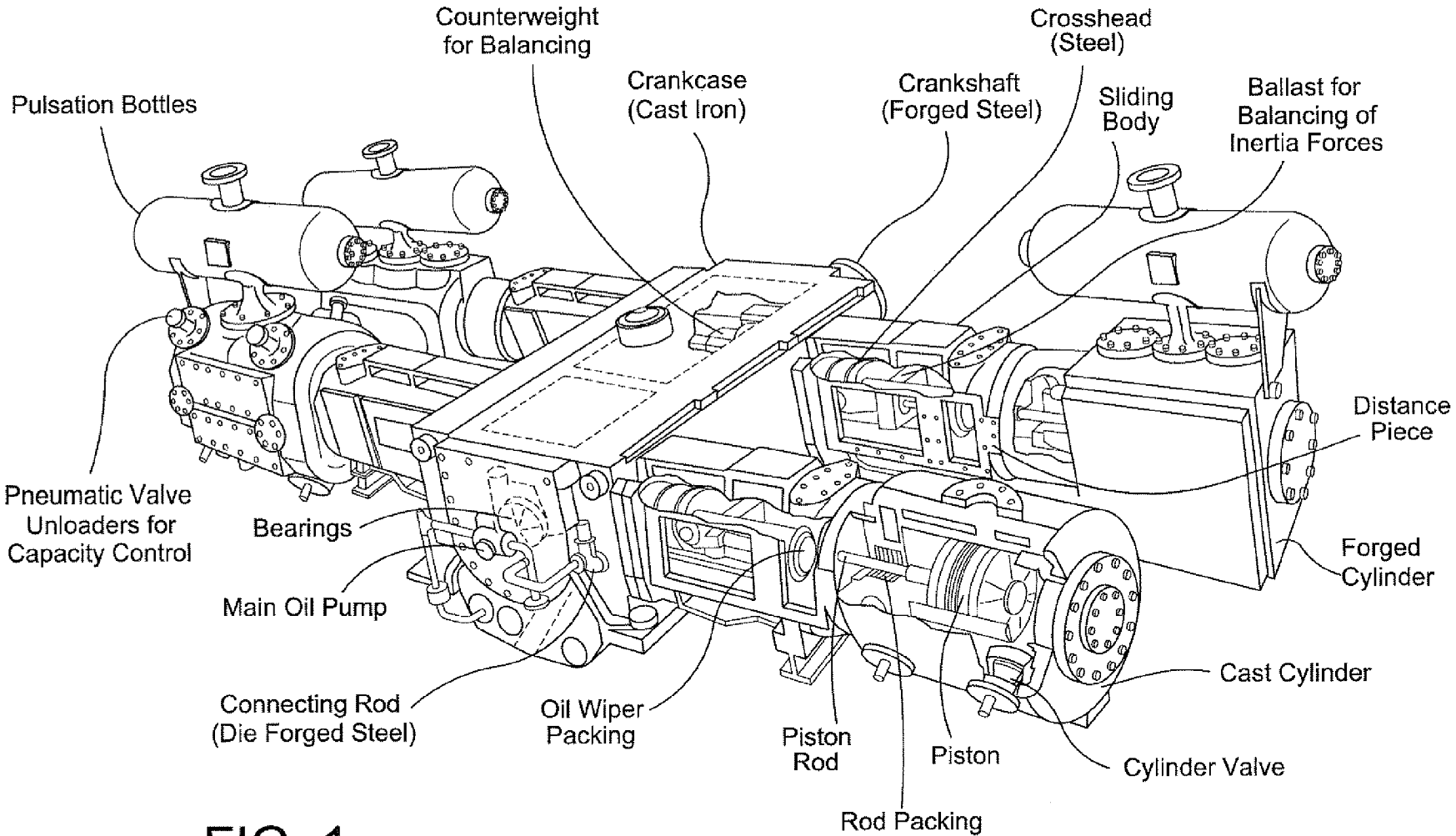
FIG. 1 illustrates a reciprocating gas compressor.

With reference to FIG. 1, in a reciprocating compressor, the thrust of a piston, within the cylinder, moves the gas through the system. This thrust enhances both the pressure and the density of the gas being transported. The main components of a reciprocating gas compressor are labeled in FIG. 1.

The reciprocating compressor is typically driven by a natural gas or diesel engine. The engine drives the crankshaft (rotational motion), and this rotational motion is converted to reciprocating motion through a series of components (connecting rod, crosshead, piston rod, piston assembly). Gas enters the cylinder body through suction valves (some cylinders have four valves while others have two valves), and the gas is compressed by the piston assembly through its reciprocating motion. After being compressed, the gas goes through the discharge valves and then onto the next stage of compression. The reciprocating compressor can be multi-staged up to four stages depending on flow, pressure, and horsepower requirements.

During normal operation, an overload event can occur when the compressor cylinder body ingests an incompressible material/object. The incompressible material/object can come in the form of a liquid (condensation, liquid carry-over) or a solid (broken valve pieces, parts of piston assembly, any foreign matter in the cylinder body). As discussed above, it would be desirable to detect the occurrence of a mechanical overload event within the compressor so that the cause of the overload can be corrected before irreparable damage is caused to the compressor components.

Figure 2:
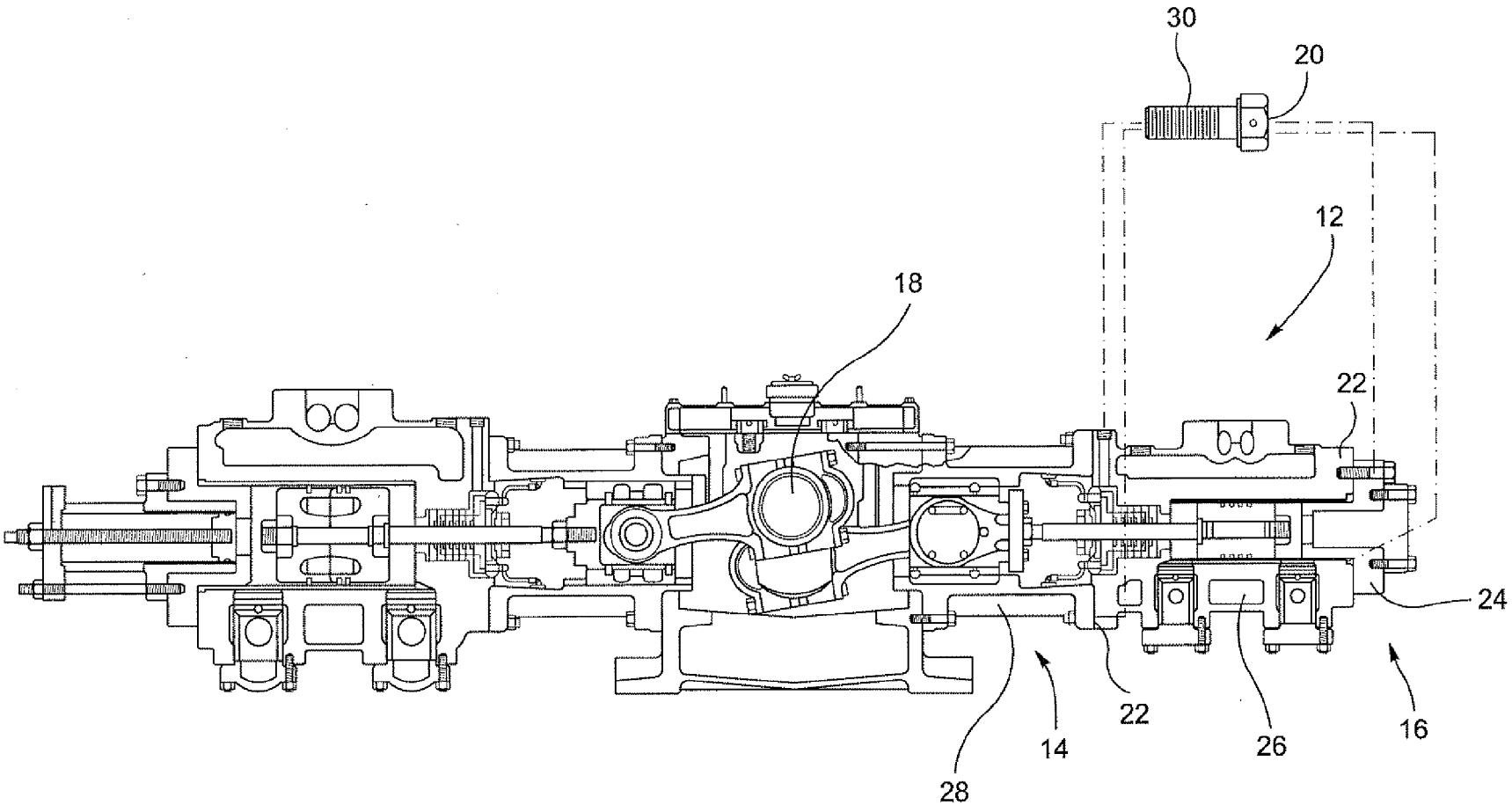
FIG. 2 is a cross-sectional view through the compressor cylinder.

FIG. 2 is a cross-sectional view through the compressor cylinder 12. A crank end 14 of the cylinder and a head end 16 of the cylinder are shown on the right side of a crankshaft 18. In order to detect an occurrence of mechanical overload, an overload indicator 20 such as a pin or a bolt is secured at an interface between components in the compressor. For example, an aperture 22 may be formed via drilling or the like through the clamp joints between the cylinder head 24 and cylinder body 26 and/or the cylinder body 26 and crosshead 28 (or distance piece) connections. The bolt/pin 20 can be secured in place at these locations through drilling of a threaded hole 22 at the cylinder head-to-cylinder body connection and/or using a bolt and nut through a drilled hole 22 at the cylinder body-to-crosshead (or distance piece) connection. The pin 20 can be used in a form of a stud and nut at both mentioned connections or any other suitable location.

The indicator 20 is designed so that under overload conditions, it will strain and provide a visual indication of an overload event. For example, the indicator body may elongate and/or a diameter of the indicator may be reduced. In one embodiment, the indicator bolt/pin is provided with indicator marks 30, wherein upon an occurrence of an overload, a position of the marks 30 is displaced relative to a fixed point.

As an alternative to a bolt or pin indicator, a strip of metal as a strain gauge may be used that could be applied across the interface. In this context, the strip may be in the shape of a "C" about both sides of a flange, spanning the interface In an event that the compressor experiences an overload, the method described herein can be used to prevent further damage to the compressor by providing indication during inspection or routine maintenance checks that an overload event had occurred. The method provides a simple, cost-effective approach to overload detection.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of detecting mechanical overload in a reciprocating gas compressor, the method comprising:

applying an overload indicator across an interface between components in the compressor; and observing a mechanical condition of the overload indicator, wherein the mechanical condition of the overload indicator is indicative of whether the compressor experienced a mechanical overload, wherein the mechanical condition is one of a mechanical deformation of the overload indicator or a mark on the overload indicator being displaced.

2. A method according to claim 1, wherein the applying step comprises forming an aperture at the interface between components in the compressor, and securing the overload indicator in the aperture.

3. A method according to claim 2, wherein the forming step comprises drilling the aperture.

4. A method according to claim 1, wherein the overload indicator is a bolt or pin, and wherein upon an occurrence of a mechanical overload in the compressor, the bolt or pin is at least one of elongated or reduced in diameter.

5. A method according to claim 1, wherein the overload indicator is a bolt or pin including at least one indicator mark, and wherein upon an occurrence of a mechanical overload in the compressor, the observing step is practicing by observing a position of the indicator mark relative to a fixed point.

6. A method according to claim 1, wherein the forming step is practiced by forming the aperture adjacent a cylinder of the compressor.

7. A method according to claim 1, wherein the forming step is practiced by forming the aperture adjacent a frame joint of the compressor.

8. A method according to claim 1, wherein the forming step is practiced by forming the aperture at one of a cylinder head-to-cylinder body connection or a cylinder body-to-crosshead connection.

9. A method according to claim 1, wherein the overload indicator is a bolt.

10. A method of detecting mechanical overload in a reciprocating gas compressor, the method comprising:

forming at least one aperture at least one joint interface adjacent one of a cylinder crank end and a cylinder head end of the compressor;

securing a corresponding at least one indicator member in the at least one aperture;

observing a mechanical condition of the indicator member, wherein the mechanical condition of the indicator member is indicative of whether the compressor experienced a mechanical overload; and directly observing the mechanical condition of the overload indicator.

11. A method of preventing damage to components of a reciprocating gas compressor due to mechanical overload, the method comprising:

applying an overload indicator across an interface between components in the compressor;

observing a mechanical condition of the overload indicator, wherein the mechanical condition of the overload indicator is indicative of whether the compressor experienced a mechanical overload;

if a mechanical overload is detected, repairing the mechanical overload source before the compressor components are irreparably damaged; and directly observing the mechanical condition of the overload indicator.

12. An apparatus for detecting mechanical overload in a reciprocating gas compressor, the apparatus comprising:

an overload indicator disposed across an interface between components in the compressor, a mechanical condition of the overload indicator being indicative of whether the compressor experienced a mechanical overload; and a compressor to which the apparatus is attached and including a cylinder body connected to a cylinder head and a crosshead connected to the cylinder body, wherein the interface is between the cylinder body and the cylinder head or between the cylinder head and the crosshead.

13. An apparatus according to claim 12, further comprising an aperture formed at the interface between components in the compressor, wherein the overload indicator is secured in the aperture.

14. An apparatus according to claim 13, wherein the overload indicator is a bolt or pin.

15. An apparatus according to claim 14 wherein the bolt or pin includes at least one indicator mark, and wherein upon an occurrence of a mechanical overload in the compressor, a position of the indicator mark is displaced relative to a fixed point.

16. A method of detecting mechanical overload in a reciprocating gas compressor, the method comprising:

applying an overload indicator across an interface between components in the compressor;

observing a mechanical condition of the overload indicator, wherein the mechanical condition of the overload indicator is indicative of whether the compressor experienced a mechanical overload; and directly observing the mechanical condition of the overload indicator.

17. A method of detecting mechanical overload in a reciprocating gas compressor, the method comprising:

applying an overload indicator across an interface between components in the compressor;

observing a mechanical condition of the overload indicator, wherein the mechanical condition of the overload indicator is indicative of whether the compressor experienced a mechanical overload; and visually observing the mechanical condition of the overload indicator.

18. A method of detecting mechanical overload in a reciprocating gas compressor, the method comprising:

applying an overload indicator across an interface between components in the compressor; and observing a mechanical condition of the overload indicator, wherein the mechanical condition of the overload indicator is indicative of whether the compressor experienced a mechanical overload, wherein the interface is between a cylinder head and a cylinder body of the compressor or between the cylinder body and a crosshead of the compressor.

* * * * *